US005853157A

United States Patent [19]

O'Donnell

[11] Patent Number: 5,853,157

[45] Date of Patent: Dec. 29, 1998

[54] APPARATUS AND METHOD FOR HOLDING A TOOL ON A CONTAINER LIP OR EDGE

[75] Inventor: Jerry L. O'Donnell, Waterloo, Iowa

[73] Assignee: DOC's Product, L. C., Waterloo, Iowa

[21] Appl. No.: 736,958

[22] Filed: Oct. 25, 1996

[51] Int. Cl.[6] ..... A47G 96/06

[52] U.S. Cl. ..... 248/213.2; 211/65; 248/113; 248/110

[58] Field of Search ..... 248/213.2, 113, 248/117.4, 117.5, 117.6, 229.16, 229.26, 230.7, 231.81, 110, 111, 112, 13; 211/65, 66

[56] References Cited

U.S. PATENT DOCUMENTS

| | | | |
|---|---|---|---|
| 1,323,924 | 12/1919 | Stevens | 248/213.2 |
| 1,540,394 | 6/1925 | Hall et al. | 248/213.81 |
| 1,622,058 | 3/1927 | Sohnle | 248/113 |
| 2,508,707 | 5/1950 | Davis | 248/110 |
| 3,661,351 | 5/1972 | Olsen | 248/110 |
| 3,948,413 | 4/1976 | Gorrell et al. | 248/110 |
| 4,121,798 | 10/1978 | Schumacher et al. | 248/113 |
| 4,266,746 | 5/1981 | Klaiber | 248/113 |
| 4,991,803 | 2/1991 | Buder | 248/113 |
| 4,993,671 | 2/1991 | Ste. Marie | 248/213.2 |
| 5,038,955 | 8/1991 | Studer et al. | 248/110 |

*Primary Examiner*—Leslie A. Braun
*Assistant Examiner*—Kimberly Wood
*Attorney, Agent, or Firm*—Zarley, McKee, Thomte, Voorhees & Sease

[57] ABSTRACT

The apparatus and method for removably holding a tool on a container having a lip or edge. The apparatus includes a cradle having a substantial open front and top. A bridge or retainer bridges a substantial part of the open portion of the cradle at an opposite end but defines an opening sufficient to allow a tool handle to pass through. A connection or mount is positioned on the underside of the cradle for releasably mounting the cradle to the lip or edge of a container. The handle can easily be placed in the substantially open cradle with the retainer bridge preventing rotation of the handle vertically, the cradle preventing any movement of the handle transverse to the longitudinal axis of the cradle, but the holder allowing the handle to be slid along the longitudinal axis of the cradle into a holding position. In one aspect of the invention, the mount consists of a generally universal clip for various size edges or lips of containers and optionally can include a locking clip for conventional paint can lips.

30 Claims, 4 Drawing Sheets

APPARATUS AND METHOD FOR HOLDING A TOOL ON A CONTAINER LIP OR EDGE

BACKGROUND OF THE INVENTION

1. Field of the Invention

The present invention relates to tool holders, and in particular, to a tool holder that can be mounted on a container having a lip or an edge.

2. Problems in the Art

The most common tools used in manual painting methods are paint brushes and rollers. Any of these tools can come in a variety of sizes and shapes, and with a variety of characteristics. For example, there are wide brush paint brushes to paint walls and large areas. There are also quite small brushes used for trim or other more delicate painting jobs. All of these tools have handles which are gripped by the user when operating the tool. Handles also can come in different sizes and widths. This is similar for any manual tool such as hammers, screwdrivers, putty knifes, etc.

Paint normally comes in cans of one gallon size or smaller. Most of these cans have a special top lip around their opening to facilitate sealing of a lid to the can. Therefore these edges or lips have a special shape that is wider than the side wall of the can and which contains at least one channel to facilitate sealing of the lid to the can.

During painting, the painter either dips the brush directly into the paint can, or pours the paint into a roller pan. Roller pans also have side walls with edges to contain the paint within the pan. These edges tend to be either straight edges or rolled edges. Sometimes pails are used, the paint being dumped into the pail. Pails also have either a straight edge or a rolled edge around the perimeter of the top opening into the pail.

In most manual painting jobs, there are many instances where the brush is laid down during the painting process, either allowing the painter to rest, do preparation work, or otherwise interrupt holding the brush. Because it is usually a major objective to avoid dripping or losing paint from the brush, one conventional way of handling laying down the brush is to lay it on or across the top edge of the paint can or pail, or roller pan. Dripping outside the paint container or pan is minimized.

However, balancing a brush on a can or pail is difficult to control. The tool is not secure and can easily be knocked off. Also it is usually undesirable to lay the brush on the ground, or even on a drop cloth. It can not be placed in one's pocket. Therefore the conventional ways of laying down a paint brush are not satisfactory and there is room for improvement in the art.

Others have recognized this need. U.S. Pat. No. 4,121,798 discloses a device that clips onto the edge of a pail or paint can. It utilizes two legs that can basically be used to clip the device over the edge of a container. Another clip or bracket is utilized with the device through which can be placed the handle of a brush. This device can be quickly clipped on to a container, holds the brush vertically and therefore attempts to position the brush so that it drips into the container if the brush portion of the tool is hanging downwardly, or resists any dripping if the tool is hung vertically upward.

Others have utilized a cradle into which the brush portion of the paint brush or the whole paint brush itself can be laid into the cradle. The cradle can then somehow be secured to the container of the paint.

While these attempts have tried to solve the problems in the art, there are still deficiencies that exist. With regard to the '798 patent, it discloses the utilization of a screw through the clip-on portion to assist in securing it to the container. This makes it somewhat cumbersome to utilize on a container. This patent also specifically discloses and teaches that the tool, a paint brush for example, is held vertically. In the situation of a paint brush, since the device holds the handle of the paint brush, and clips onto the top edge of the container, the paint brush bristles would extend well inside the container if the paint brush is installed bristles down and would be difficult to use. If installed bristles up, paint may drip from the bristles down onto the handle of the brush, which is undesirable. Still further, the clip is not universal because it would not necessarily work well over the wide lip of a paint can. Likewise, the holder of the tool handle is not universal. It must be matched fairly closely to the width and circumference or cross-section of a paint brush handle.

With regard to the cradle described above, by making it the size of the paint brush bristles, it is essentially the same size as the brush itself, compared to the '798 device which is quite small. Also, placement of a paint brush with the bristles full of paint into a pan or cradle would drip paint into the cradle which would be messy for cleanup. It is also difficult to utilize such a device for different sizes of paint brushes and it may be difficult to place it relative to the paint container in a manner that is not difficult to utilize and allows free access to the paint in the container.

There is therefore a need in the art for a small, generally universal tool holder for different sizes of tools and different types of containers, which is easy to place, relatively securely holds the tool.

An object of the present invention is to overcome the problems and deficiencies in the art.

A still further object to the present invention is to provide a tool holder for various types of tools whereby the handle is held relatively securely and the working end is positioned free of the holder.

These and other objects, features, and advantages of the present invention will become more apparent with reference to the accompanying specification and claims.

SUMMARY OF THE INVENTION

The present invention is an apparatus and method for holding a tool on a container having a lip or edge. The apparatus includes a cradle for at least a portion of the tool handle. The cradle has a substantially open front end and top. A handle retainer is positioned at or near the back end of the cradle and deters tipping of the handle when placed in the apparatus. A connection component is positioned underneath the cradle for quick mounting and release of the apparatus to a container having a lip or edge.

The method according to the invention includes supporting the bottom side of the tool handle along a portion of the length of the handle, and preventing the tool from moving any substantial distance transverse to the longitudinal axis of the cradle so that the tool handle can be easily inserted into the cradle and yet held relatively secure in the cradle.

DETAILED DESCRIPTION OF THE PREFERRED EMBODIMENT

Figure 1:
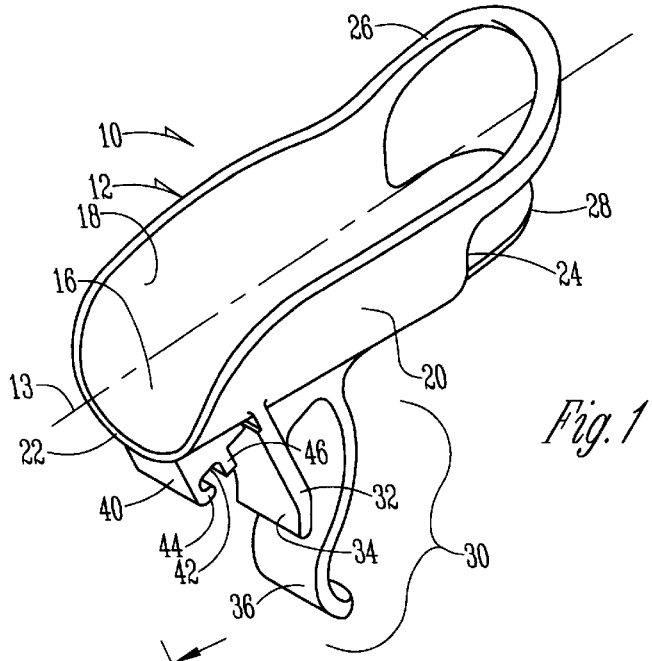
FIG. 1 is a perspective view of an apparatus according to the present invention.

To assist in a better understanding of the invention, one embodiment the invention can take will now be described in detail. Frequent reference will be taken to the drawings. Reference numbers will be used to indicate certain parts or locations in the drawings. The same reference numerals will be used to indicate the same parts and locations throughout all the drawings unless otherwise stated.

FIG. 1 shows a holder 10 according to the present invention. It is to be understood that holder 10 will be discussed in the context of holding paint brushes. However, holder 10 can be used with tools of a variety of types, for example, screw drivers, hammers, putty knives, wrenches, etc. It could also be used with such things as fishing poles, flags, or other devices having a handle or pole end.

Holder 10 includes what will be called a cradle 12 having a longitudinal axis indicated with broken line 13 in FIG. 1, and including what will be called a bottom or central supporting surface 16, opposite side walls 18 and 20, front end 22, and rear end 24. What will be called bridge 26 extends from the upper side walls 18 and 20 of rear end 24 of cradle 12 in a loop that bridges sidewalls 18 and 20 at that location. A tail 28 extends from supporting surface 16 of rear end 24 of cradle 12 generally in the same plane and outwardly from supporting surface 16.

Mount 30 for holder 10 is a combination of three downwardly extending members from the bottom of the cradle 12, beginning from the front end 22 and ending generally in the middle of cradle 12. A first leg 32 extends downwardly from underneath cradle 12 and has a bent portion 34 at its outer end. A second leg 36 is towards rear end 24 or behind first leg 32 underneath cradle 12 and is somewhat S-shaped. Third leg 40 extends downwardly underneath front end 22 of cradle 12 and includes a channel 42 transverse to longitudinal axis 13 of cradle 12 that is characterized or defined by an L-shaped flange 44 and a ledge 46.

As will be further described below, cradle 12 is shaped so that it has an open front end 22 and top. This allows easy insertion of a tool handle into cradle 12 for support. The tool handle is slid back far enough so that it passes through bridge 26. Bridge 26 and tail 28 prevent the handle from moving very much vertically and sidewalls 18 and 20, in conjunction with bridge 26, prevent very much movement transverse of longitudinal axis 12. Because the working end of the tool, for example a paint brush, generally equals or exceeds the weight of the handle, bridge 26 will prevent rotation of the tool in cradle 12 to where it would not be retained by holder 10 and yet allows easy and quick insertion and removal.

As will further be discussed below, mount 30 provides several options of quick attachment and detachment from a variety of different containers having top lips or edges.

Figure 2A:
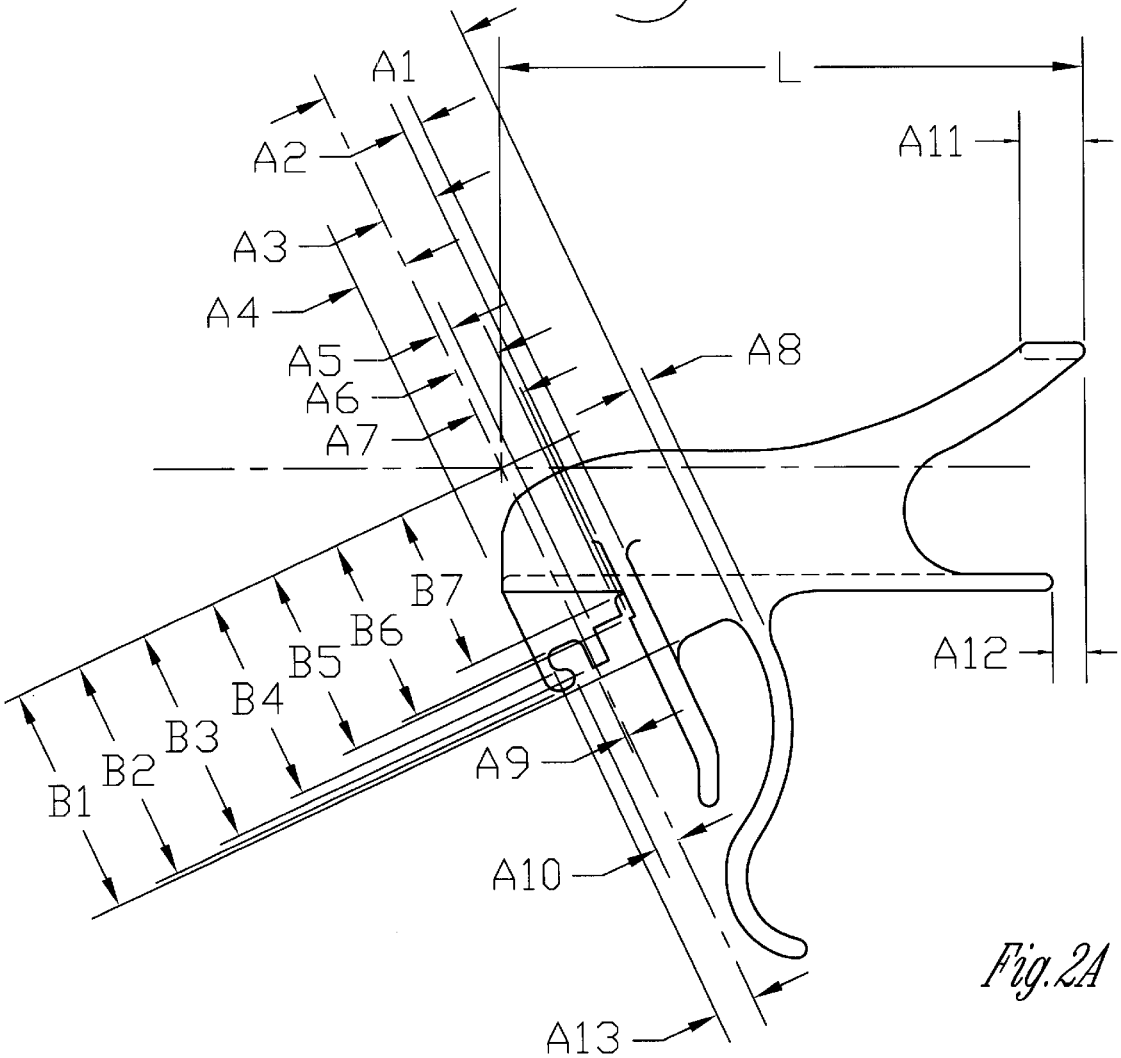
FIG. 2A is a side elevational view of the device of FIG. 1 and includes dimensional indicators.
Figure 2B:
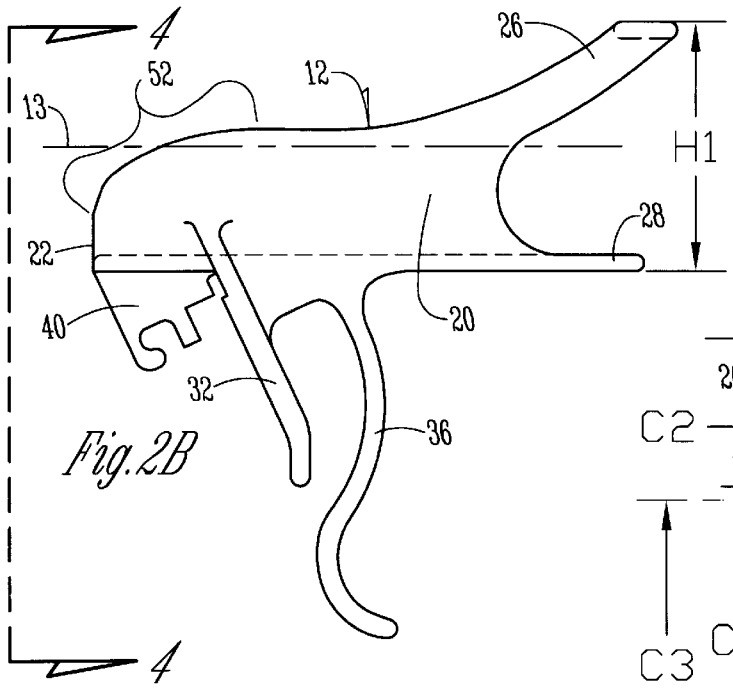
FIG. 2B is identical to FIG. 2A without dimensional indicators.

By referring to FIGS. 2A, 2B, and 3–5, some specific structural features and relationships of holder 10 can be better pointed out. In FIG. 2B, it can be seen that the top fronts of sidewalls 18 and 20 are rounded (see reference numeral 52). This assists insertion and removal of the tool from holder 10. As can be appreciated, bridge 26 prevents a handle from tipping upwardly and yet its swept back, angled extension from cradle 12 provides a broad open top for cradle 12 to assist in easy insertion and removal of tool handle. On the other hand, tail 28 prevents the tool from rotating downwardly and becoming vertically disposed at the rear of holder 10.

FIG. 2B also shows that in the preferred embodiment, first, second, and third legs 32, 36, and 40 are all angled relative to longitudinal axis 13 at approximately 15°. While any number of orientations would be acceptable, including having all three legs generally orthogonal to axis 13, the 15° offset allows the handle to tilt upwardly against the top of bridge 26 to some degree and approach horizontal, or hold the tool angled somewhat upwardly to prevent drainage of paint out of paint bristles, for example.

The lower portion of second leg 36, relative to first leg 32 is such that upon insertion around paint trays and pails, the S-shaped second leg has spring memory and functions to clamp holder 10 to the container. The gap between legs 32 and 36 is selected so that it can almost universally fit over all types of paint trays and pails. Second leg 36 would usually abut and apply pressure to the outside of the container whereas first leg 32 would abut the inside of the container.

On the other hand, third leg 40 cooperates with first leg 32 to provide a locking clip or locking action for holder 10 to a conventional paint can top lip. First leg 32 would abut against the outside of the paint can. L-shaped flange 44 and ledge 46 would snap into the channel around the top of conventional paint cans which receives a mating flange on the paint can lid for sealing action. The relationships are fairly standard with paint cans and similar containers so that this relationship can be used for most paint cans. Although legs 32 and 40 might also be used for paint cans because of their relatively universal nature, the width and configuration of the sealing lips for paint cans makes it more difficult to use a universal clip and therefore leg 40 with leg 32 can achieve a more secure mount.

Figure 3:
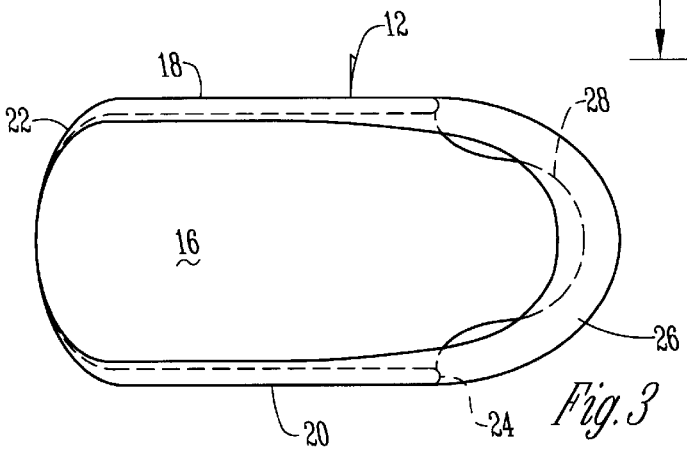
FIG. 3 is a top plan view of the device of FIG. 1.
Figure 5:
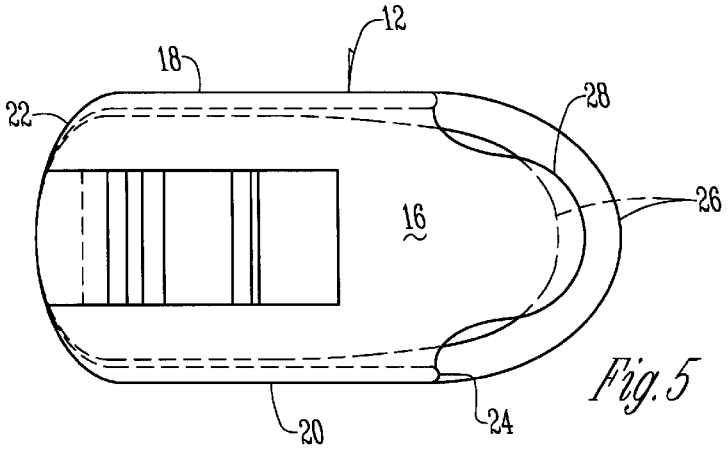
FIG. 5 is a bottom plan view of the device of FIG. 1.

FIG. 3 illustrates that sidewalls 18 and 20 can increase in thickness towards their rearward ends. This serves to help channel or center the tool handle as it is slid farther back in holder 10. Additionally, FIG. 3 shows the vertical relationship between tail 28 and bridge 26 and how they are generally vertically aligned. FIG. 3 also shows that walls 18 and 20 are not only rounded at the front end of cradle 12 from a vertical perspective but also the entire front end 22 is rounded.

Figure 4:
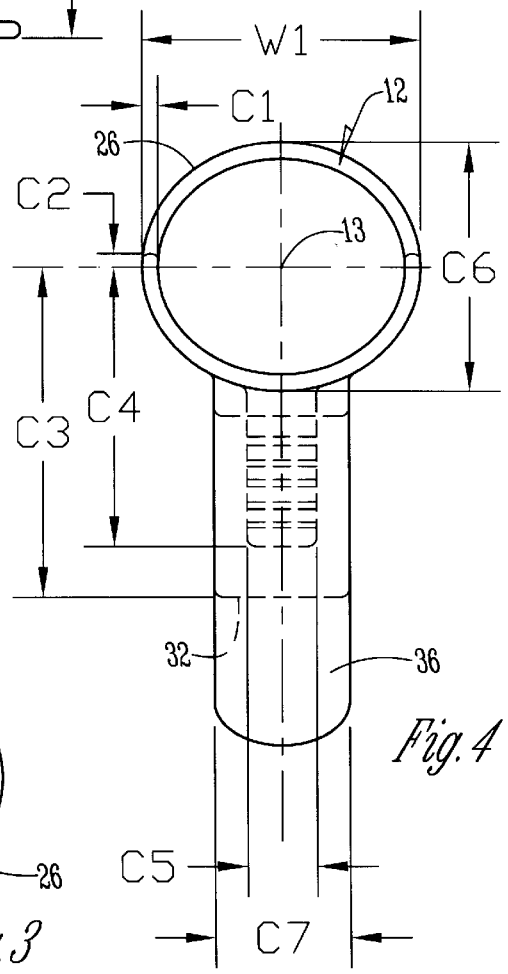
FIG. 4 is an end elevational view taken along line 4—4 of FIG. 2B.

FIG. 4 illustrates that the basic shape of cradle 12 and bridge 26 is ovular. It has been found that this shape is more advantageous for centering and holding handles, and tends to assist in having the handles lay flatter than a more circular or squarer shape.

Although holder 10 can take on many configurations, in the preferred embodiment, its entire length is 3.5" and its side to side width is 1.7" (W1 at FIG. 4). Its top to bottom height (H1 of FIG. 2B) is 1.5" for cradle 12 and bridge 26.

Other dimensions of the preferred embodiment are set forth below:

| REFERENCE NUMERAL | NUMBER IN INCHES |
|---|---|
| A1 | 0.94 |
| A2 | 0.06 |
| A3 | 0.360 |
| A4 | 0.30 |
| A5 | 0.065 |
| A6 | 0.290 |
| A7 | 0.305 |
| A8 | 0.10 |
| A9 | 0.035 |
| A10 | 0.165 |
| A11 | 0.38 |
| A12 | 0.20 |
| A13 | 0.75 |
| B1 | 1.40 |
| B2 | 1.300 |
| B3 | 1.260 |
| B4 | 1.175 |
| B5 | 1.130 |
| B6 | 1.060 |
| B7 | 1.00 |
| C1 | 0.10 |
| C2 | 0.10 |
| C3 | 2.00 |
| C4 | 1.70 |
| C5 | 0.40 |
| C6 | 1.50 |
| C7 | 0.75 |
| H1 | 1.5625 |
| L | 3.50 |
| W1 | 1.70 |

Figure 6:
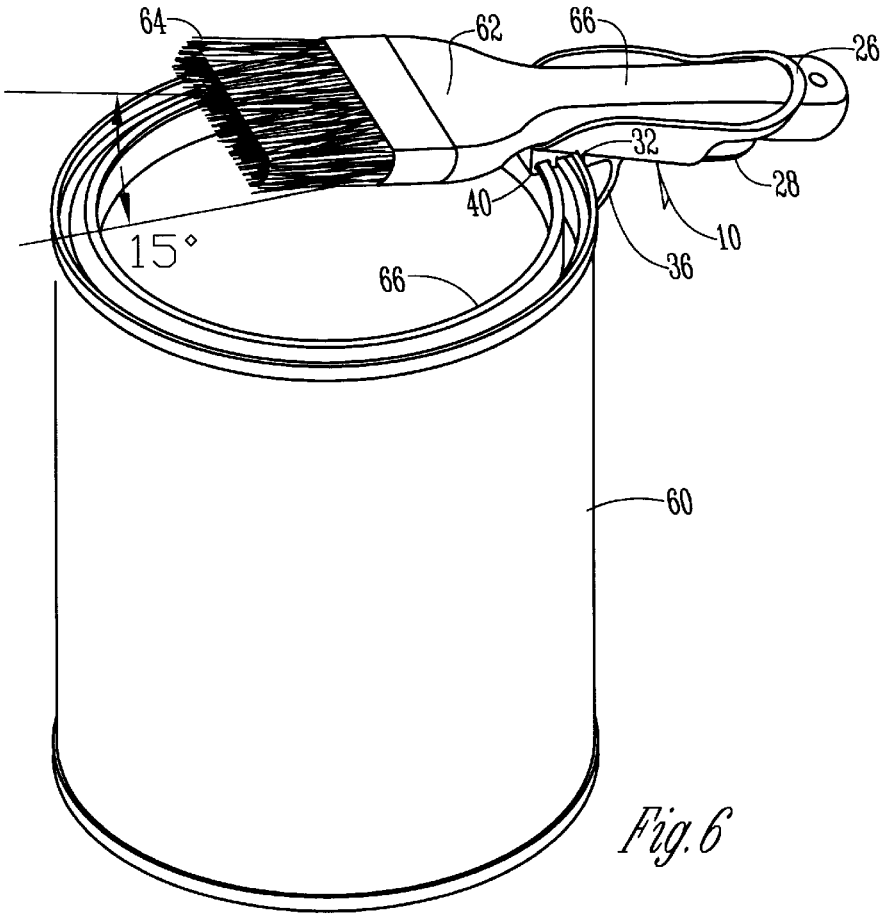
FIG. 6 is a diagrammatical depiction of utilization of the device of FIG. 1 with a conventional paint can and paint brush.
Figure 7:
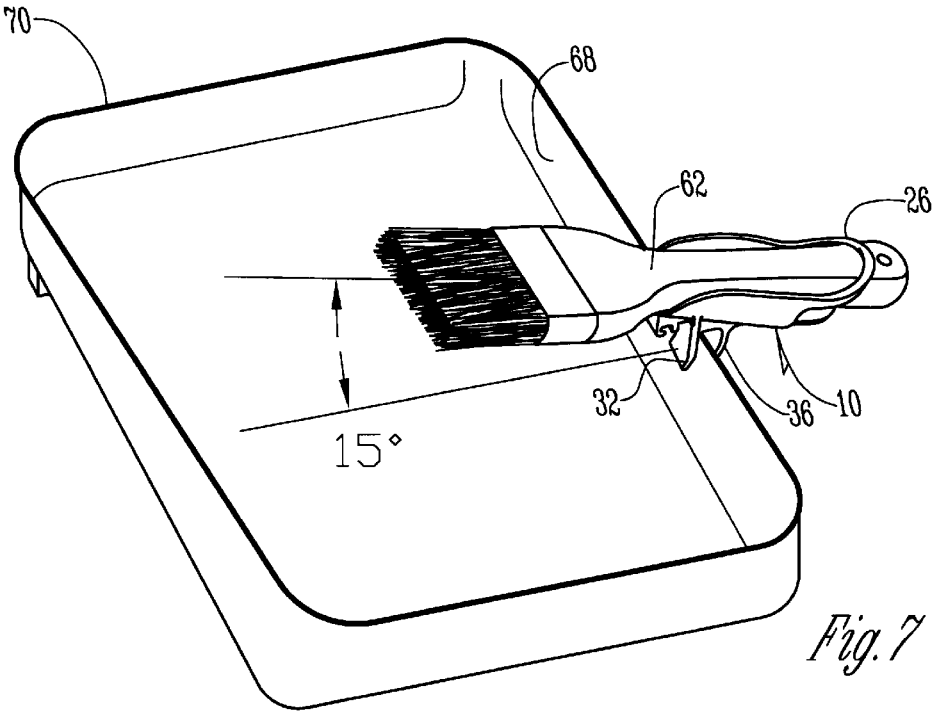
FIG. 7 is a diagrammatical depiction of use of the device of FIG. 1 with a conventional paint roller pan and paint brush.
Figure 8:
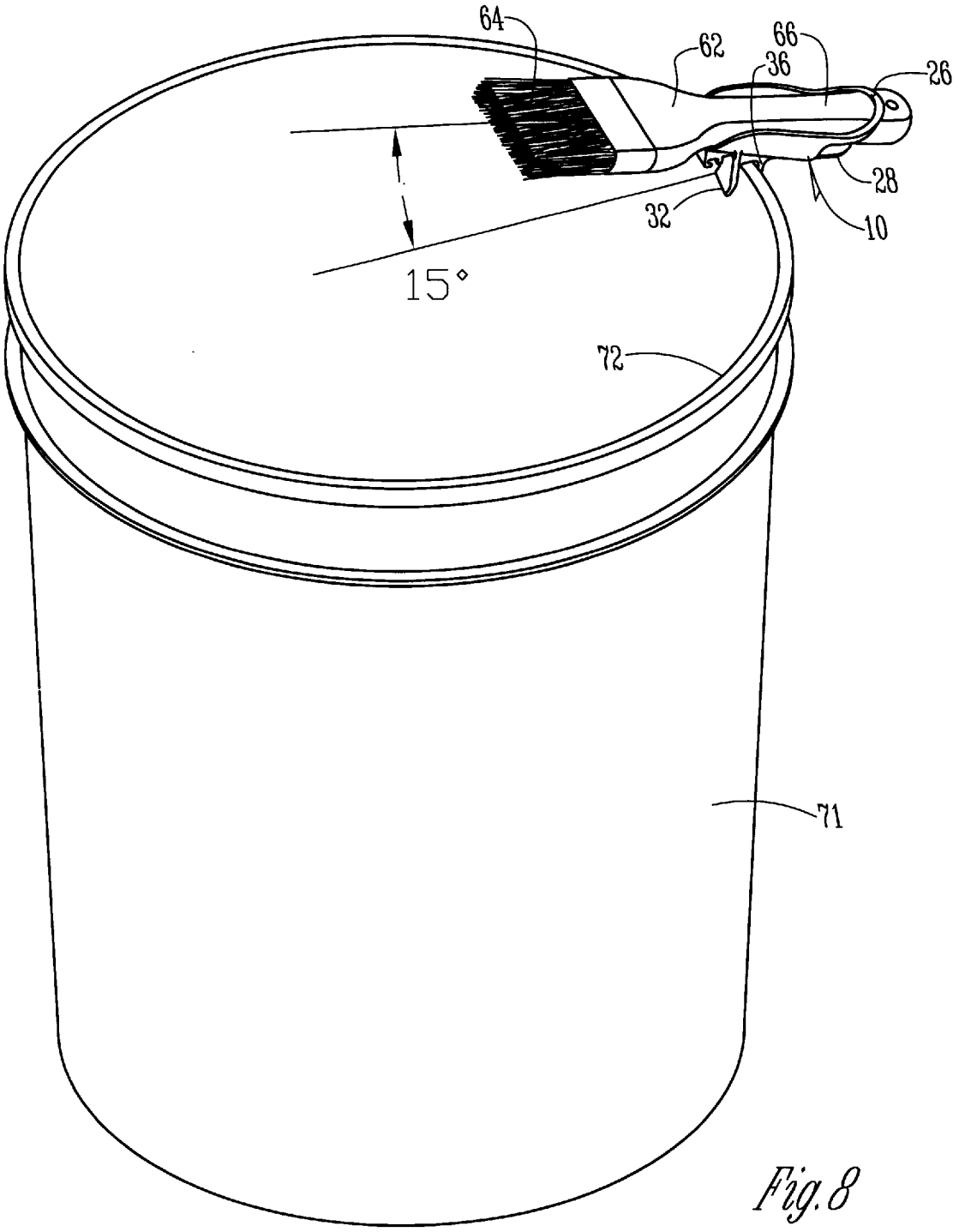
FIG. 8 a diagrammatic depiction of use of the device of FIG. 1 with a paint brush on a conventional pail.

FIGS. 6–8 illustrate diagrammatically some of the uses of holder 10. In FIG. 6, a conventional one gallon paint can with its special but conventional lip 66 utilizes first leg 32 and third leg 40 of mount 30 to lock holder 10 to paint can 60. A paint brush 62 having bristles 64 and a handle 66 is held by holder 10 so that bristles 64 extend over the opening to can 60 so drips will fall into can 60. Handle 66 is slid into and through cradle 12 so that the end of handle 66 extends past bridge and tail 26 and 28. The weight of bristles 64 and the head of paint brush 62 will tend to try to rotate handle 66 upward. Bridge 26 will serve as a mechanical stop to such rotation. Tail 28 will prevent brush 62 from being lifted up at its head or bristles end and having handle 66 slide all the way through bridge 26 and stand vertically with bristles 64 up in the air.

As seen in FIG. 6, holder 10 therefore attaches to the lip of can 60, is relatively small in size, extends outwardly from the lip to leave the whole opening to can 60 relatively unobstructed when paint brush 62 is taken out of holder 60, and yet holds brush 62 in a relatively secure, controlled manner when in holder 10.

FIG. 7 shows a conventional roller pan 70. Holder 10 holds brush 62 to a sidewall 68 of pan 70 with legs 32 and 36.

FIG. 8 is similar to 6 excepts shows brush 62 in holder 10 attached to a conventional five-gallon pail 71. In this instance legs 32 and 36 are used for clipping holder 10 to the upper lip 72 of pail 71.

The included preferred embodiment is given by way of example only, and not by way of limitation to the invention, which is solely described by the claims herein. Variations obvious to one skilled in the art will be included within the invention defined by the claims.

For example, holder 10 is made out of a plastic material. Examples are polypropylene and polyethylene. Such material would be durable, would not corrode, would be easily washed or would easily take a variety of substances such as paints, paint thinners, or the like, without degradation, and could also allow some flexing or resilience that is desired, for example, with third leg 40. Other materials are possible, however, and different materials can be used to make different portions of a holder 10, although it is preferred that it be made of a single material so that it could be molded or achieve similar economies in manufacturing.

Also, the size of various components of holder 10 can be varied. However, the sizes selected have been done so to provide a relatively universal application to most paint brushes.

Additionally, holder 10 could be utilized with a variety of tools.

Still further, it is not necessary that all three legs 32, 36 and 40 be utilized. A holder 10 dedicated to use with paint cans could include just legs 32 and 40. Further, leg 40 is not necessarily required for operation of holder 10. still further, the configuration and nature of mount 30 could vary widely for different applications or according to need or desire.

Still further, tail 28 is not necessarily needed but has a specific function to prevent the paint brush or tool from standing up vertically in holder 10. Moreover, bridge 26 does not have to completely span sidewalls 18 and 20, but could substantially span that space sufficiently to prevent a tool handle from passing upwardly. Similarly, cradle 12 does not have to be a continuous solid surface, but could have breaks or openings, or furthermore could be fashioned out of discrete structural members if desired.

What is claimed is:

1. An apparatus for attachment to a container such as a paint can, pail, or paint tray having a lip or edge, to selectably hold a tool such as a paint brush having a handle with a length and width grippable by one hand of a user and a working end comprising:

a tool handle cradle having a front end, back end, bottom and opposite upwardly extending sidewalls, and a substantially open front end, back end, and top all aligned along a longitudinal axis whereby said opened front end permits said paint brush to extend outwardly therefrom in cantilever fashion, the cradle having a generally consistent width from substantially open front end to substantially open back end;

a handle retainer unitary with the cradle and positioned at a back end of the cradle, the handle retainer forming a substantially closed loop extending up and over the top of the cradle at or near the back end of the cradle and defining a handle-receiving opening;

a container connection positioned on the bottom of the cradle.

2. The apparatus of claim 1 wherein the bottom and sidewalls combine into a continuous curved shape.

3. The apparatus of claim 2 wherein a cross-section of the curve shape is ovular.

4. The apparatus of claim 1 wherein the front end of the cradle is rounded.

5. The apparatus of claim 1 wherein the handle retainer comprises a bridge over the open top of the cradle.

6. The apparatus of claim 5 wherein the bridge includes legs extending backwards from the cradle to a top bridging portion.

7. The apparatus of claim 6 wherein the bridge extends upward and behind the top of the cradle.

8. The apparatus of claim 6 wherein the bridge defines an opening large enough to receive a handle.

9. The apparatus of claim 1 wherein the handle retainer comprises a bridge extending between opposite sides of the cradle and a tail extending backward from the cradle.

10. The apparatus of claim 9 wherein the cradle opposite sidewalls are connected to the bottom and, the tail extends backwardly from the bottom.

11. The apparatus of claim 10 wherein the bridge is positioned backward from the tail.

12. The apparatus of claim 1 wherein the container connection comprises a clip mechanism.

13. The apparatus of claim 12 wherein the clip mechanism includes first and second legs spaced apart and extending generally in the same direction from underneath the cradle and away from the cradle.

14. The apparatus of claim 13 wherein the first leg is wider than the second leg.

15. The apparatus of claim 14 wherein the second leg is longer than the first leg.

16. The apparatus of claim 15 wherein the second leg is resilient.

17. The apparatus of claim 13 wherein the first and second legs are spaced to receive a lip or edge of a container.

18. The method of claim 13 further comprising a third leg in front of the first leg.

19. The apparatus of claim 18 wherein the third leg is shorter and narrower than the first leg.

20. The apparatus of claim 18 wherein the third leg is transverse across the bottom of the cradle and includes a channel through it, the channel being open at the bottom of the third leg.

21. The apparatus of claim 20 wherein inwardly extending lip extends along the channel.

22. The apparatus of claim 1 wherein the container connection comprises legs extending generally orthogonal to a cradle.

23. The apparatus of claim 1 wherein the container connection comprises legs extending generally obliquely to the cradle.

24. The apparatus of claim 23 wherein the legs extend generally rearward with respect to the cradle.

25. The apparatus of claim 24 wherein the legs extend approximately 10°–40° rearwardly relative to the cradle.

26. The apparatus of claim 25 wherein the legs extend approximately 28° rearwardly relative to the cradle.

27. A tool holder for attachment to a container having a lip or edge for temporarily holding a tool having a handle grippable by one hand of a user and having a working end, comprising:

a tool handle support having opposite ends, a bottom and opposite sides defining a handle supporting member aligned along a longitudinal axis;

retaining walls extending upwardly from opposite sides of the handle support along the longitudinal axis;

the handle supporting member having a length and a width and a substantially open top along the length and open front and back ends whereby said opened front end permits said paint brush to extend outwardly therefrom in cantilever fashion, the width being substantially the same between the opposite ends;

an anti-tip substantially closed loop handle retainer at or near one of said opposite ends of the handle support to prevent a portion of a handle positioned along the longitudinal axis and through the handle from moving any substantial distance from the handle support other than substantially along the longitudinal axis;

the anti-tip handle retainer comprising a structure extending above and over the cradle, the anti-tip handle retainer defining a handle-receiving opening;

a mounting member connected to the handle support to receive a lip or edge of a container.

28. The tool holder of claim 27 comprising a paint tool holder for holding a tool selected comprising a paint brush.

29. The tool holder of claim 27 comprising a tool holder for attachment to a container selected from the set comprising a can, tray, or pail or box.

30. The tool holder of claim 27 wherein the tool is selected from the set comprising a handled device, a flag and flag pole, and a fishing pole.

* * * * *